US008282103B2

(12) United States Patent
Stanoch

(10) Patent No.: US 8,282,103 B2
(45) Date of Patent: Oct. 9, 2012

(54) APPARATUS AND METHOD FOR STRATEGY GAMES

(76) Inventor: John F. Stanoch, Robbinsville, NJ (US)

( * ) Notice: Subject to any disclaimer, the term of this patent is extended or adjusted under 35 U.S.C. 154(b) by 259 days.

(21) Appl. No.: 12/830,824

(22) Filed: Jul. 6, 2010

(65) Prior Publication Data

US 2012/0007309 A1 Jan. 12, 2012

(51) Int. Cl.
*A63F 3/02* (2006.01)
*A63F 11/00* (2006.01)

(52) U.S. Cl. ..... 273/289; 273/290; 273/241; 273/255; 273/262; 273/265; 273/288; 446/102; 446/105; D21/386

(58) Field of Classification Search ..... 273/241, 273/255, 261, 262, 265, 288, 289, 290; 446/105, 446/102; D21/386
See application file for complete search history.

(56) References Cited

U.S. PATENT DOCUMENTS

| | | | | | |
|---|---|---|---|---|---|
| 1,072,190 | A * | 9/1913 | Stein | 273/254 |
| 3,167,313 | A * | 1/1965 | Davenport et al. | 273/262 |
| 3,556,526 | A * | 1/1971 | Currie | 273/239 |
| 3,759,523 | A * | 9/1973 | Randolph | 273/291 |
| 4,055,346 | A * | 10/1977 | Garcia-Kuenzli | 273/262 |
| 4,317,570 | A * | 3/1982 | Brunton | 273/246 |
| 4,534,567 | A * | 8/1985 | Ferris et al. | 273/255 |
| 2004/0051243 | A1 * | 3/2004 | Long, Jr. | 273/243 |
| 2004/0051245 | A1 * | 3/2004 | Weisman et al. | 273/262 |

* cited by examiner

*Primary Examiner* — Benjamin Layno
(74) *Attorney, Agent, or Firm* — Walter J. Tencza, Jr.

(57) ABSTRACT

A flight stand apparatus for use in playing a airplane combat game including a deck having a first attachment device and a deck top surface, a base having a first opening, and an altitude pole having a first end and an opposing second end. The altitude pole and the base may be configured so that the first end of the altitude pole is adapted to be inserted into the first opening of the base, and the altitude pole is thereby temporarily fixed to the base so that the altitude pole is substantially at a right angle with respect to the base. The first attachment device of the deck is configured to temporarily fix the deck on the altitude pole between the first end and the second end of the altitude pole, so that the deck top surface is substantially at a right angle with respect to the altitude pole and substantially parallel to the base.

11 Claims, 11 Drawing Sheets

APPARATUS AND METHOD FOR STRATEGY GAMES

FIELD OF THE INVENTION

This invention relates to improved methods and apparatus concerning strategy games.

BACKGROUND OF THE INVENTION

There are various devices known in the prior art for strategy games. There are a series of strategy games known in the art as the "Blue Sky Series" of games. These games related to air plane military combat throughout history. The basic rules regarding the "Blue Sky Series" of games were copyrighted and published at least as early as 1996. Various rule modifications have also been published.

SUMMARY OF THE INVENTION

In at least one embodiment of the present invention, an apparatus is provided for use in playing a game comprising a deck having a first attachment device and a deck top surface, a base having a first opening, and an altitude pole having a first end and an opposing second end. The altitude pole and the base are configured so that the first end of the altitude pole is adapted to be inserted into the first opening of the base, and the altitude pole is thereby temporarily fixed to the base so that the altitude pole is substantially at a right angle with respect to the base. The first attachment device of the deck is configured to temporarily fix the deck on the altitude pole between the first end and the second end of the altitude pole, so that a deck top surface is substantially at a right angle with respect to the altitude pole and substantially parallel to the base.

The apparatus may further include a first dial, wherein the base includes a first indentation into which the first dial is adapted to fit snugly. The apparatus may further include a second dial, wherein the base includes a second indentation into which the second dial is adapted to fit snugly. The first dial and the second dial may have a plurality of alphanumeric designations on it. The altitude pole may include means for temporarily fixing the deck at a plurality of different heights with respect to the base. The means for temporarily fixing the deck at a plurality of different heights with respect to the base may include a plurality of grooves, wherein the first attachment device fits into one of the plurality of grooves in order to fix a height of the deck with respect to the base.

The apparatus may further include a model airplane which is adapted so that it can sit on the deck, after the deck has been temporarily fixed on the altitude pole. A cutout may also be provided, having an opening which allows the cutout to be attached to the altitude pole, wherein the cutout has an image of an airplane on it.

The deck and the base may have substantially the same hexagonal shape. A playing surface and/or playing board may be provided comprised of a plurality of hexagonal shaped spaces each of which is approximately the same size or slightly larger than the hexagonal shapes of the base and the deck.

At least one or more embodiments of the present invention may provide a method of playing a game involving military airplane combat. The game may use the apparatus previously mentioned.

An apparatus, which may be called a flight stand device, and which may include the base, the deck, and the altitude pole, in accordance with an embodiment of the present invention may depict three-dimensional positioning and movement of a game-piece aircraft when used in a specific game.

The apparatus or flight stand device may be used in the known "Blue Sky Series" (of games.

At least one embodiment of the present invention also provides a plurality of new rules or rule modifications for playing a "Blue Sky Series" related game. The new rules, rule modifications or modified game may be called "Black Cross/Blue Sky". The "Black Cross/Blue Sky" modified game relates to the Battle of Britain in 1940. The "Black Cross/Blue Sky" modified game can be played with both cardboard cutouts with airplane images or metal diecast airplane models. The prior "Blue Sky Series" games were a set of rules for use with diecast models only. The flight stand device or apparatus of at least one embodiment of the present invention is additional gaming aim that now allows players to use both cardboard cutouts for airplanes (for example) and metal model aircraft.

DETAILED DESCRIPTION OF THE DRAWINGS

Figure 1A:
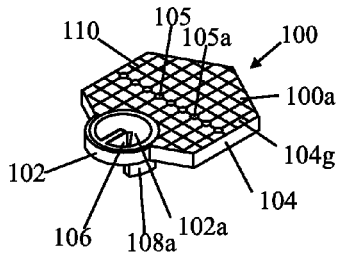
FIG. 1A shows a top perspective view of a deck in accordance with an embodiment of the present invention.

FIGS. 1A, 1B, 1C, 1D, 1E, 1F, 1G, and 1H show top perspective, bottom perspective, top, bottom, front, back, left, and right side views, respectively of a deck 100 in accordance with an embodiment of the present invention.

The deck 100 includes sections 102, 104, and 106. The section 102 is substantially circular. There is an opening or bore 102*a* shown in FIG. 1A in or through the section 102. The section 106 may be a flat protrusion which is fixed to the section 102. The section 104 may be flat and may have a top surface 100*a* on which a grid pattern 110 including a plurality of rows and columns of grid lines is shown. The section 104 may have a plurality of holes 105 which may be in a straight line, and which includes hole 105*a* shown in FIG. 1A. The holes 105 are used for the variable placement of pin 610. The section 104 includes a flat portion 104*g* which is bordered and/or surrounded by walls 104*a*, 104*b*, 104*c*, 104*d*, 104*e*, and 104*f*. The section 104 may have a width W1, shown in FIG. 1A, from wall 104*c* to wall 104*f* of one and one eighth inches. The section 104 may have a length L1, shown in FIG. 1C, from the farthest end of circular section 102 to the intersection of walls 104*a* and 104*b* of one and one half inches. The base 100 includes protrusions 108*a*, 108*b*, and 108*c* which are fixed to and which extend out perpendicularly from circular section 102 as shown in FIG. 1B. The protrusions 108*a-c* have ridges 109*a-c*, respectively, as shown by FIGS. 1E-1H. The ridges 109*a-c* are used to snap the deck 100 into place on a pole 400 of FIG. 4A. The deck 100 has an overall hexagonal appearance or shape. The deck 100 may be made of plastic.

The base 200 is designed to fit a game board printed surface of a map of various geographic locations of aerial battles with a superimposed hexagonal grid comprised of thirty-four mm (millimeter) hexagonal spaces. The section 208 of the base 200 can be used as a pointer to denote direction of a game piece aircraft which includes base 200. Dials, such as dial 300 can be attached to the base 200 by inserting section 304 into either section 202A or 204A to rotate to desired quantity of desired function, i.e. specific altitude level and/or sagittal direction of the aircraft game piece FIGS. 2A, 2B, 2C, 2D, 2E, 2F, 2G, and 2H show top perspective, bottom perspective, top, bottom, front, back, right, and left side views, respectively of a deck 200 in accordance with an embodiment of the present invention. The base 200 includes section 201 and circular section 206. The section 201 has indentations 202 and 204, each of which is shaped as a circular arc of approximately two hundred and seventy degrees. The indentations 202 and 204 have holes 202*a* and 204*a* at the center of the circular arc shape. The section 201 has side walls 201*a*, 201*b*, 201*c*, 201*d*, 201*e*, and 201*f*. The side walls 201*b*, and 201*f* have slots 203*b* and 203*f*, respectively. The purpose of these slots is to denote the value of the dial 300. The section 201 has an upper surface 201*g*. The circular section 206 has a protruding tab 206*a* fixed to it. The circular section 206 has a circular opening or bore 206*b*.

Figure 7:
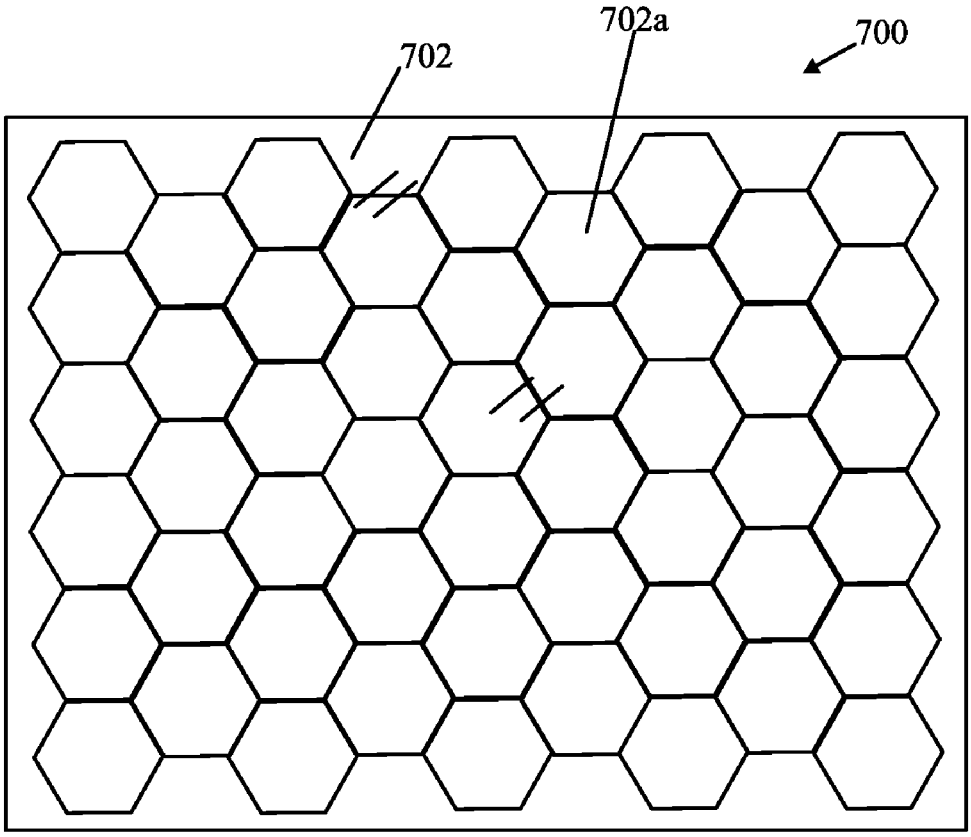
FIG. 7 shows a game board in accordance with another embodiment of the present invention.

The base 200 is generally used for placement of the game piece on a hexagonal grid game board, such as a game board 700 shown in FIG. 7. The base 200 may be made of plastic.

FIGS. 3A, 3B, 3C, 3D, 3E, 3F, 3G, and 3H show top perspective, bottom perspective, top, bottom, right, left, front, and rear side views, respectively of a first dial 300 in accordance with an embodiment of the present invention.

The first dial 300 includes a section 302 which is circular or substantially circular and which has a plurality of ridges 303, such as ridge 303*a*, on its perimeter or periphery. The ridges 303 form a plurality of slots or indentations 305, such as slot 305*a*. There is an opening 306 in the section 302. An extension 304 is fixed to a bottom surface 302*b* of the first dial 300. The extension 304 includes a pole or member 304*a* and a flange or triangular shaped protrusion 304*b*. A top surface

302*a* of the first dial 300 has printed thereon, characters which stand for the following: SC=Steep Climb, C=Climb, L=Level, D=Dive, SD=Steep Dive.

A second dial 850 is typically the same as 300 only with different characters which are the numbers: 1, 2, 3, 4, 5 and 6. The first dial 300 and the second dial 850 can both be made of plastic.

FIGS. 4A, 4B, 4C, 4D, 4E, and 4F show front top perspective, rear top perspective, front, rear, top, and bottom views, respectively of an altitude pole 400 in accordance with an embodiment of the present invention.

The altitude pole 400 includes a section 401 comprised of sections 402, 404, 406, 408, and 410. There are indentations or slots 402*a*, 404*a*, 406*a*, and 408*a* between the sections 402 and 404, 404 and 406, 406 and 408, and 408 and 410, respectively. The altitude pole 400 also includes a section 414. Section 414 includes extensions 414*a* and 414*b*, and protrusions 415*a* and 415*b*. A gap or slot 416 lies between extensions 414*a* and 414*b* and between protrusions 415*a* and 415*b*. There is an elongated slot 412 which runs the length of section 401, as shown in FIG. 4B. The altitude pole 400 is typically made of plastic.

FIGS. 5A, 5B, 5C, 5D, 5E, 5F, 5G, and 5H show front top perspective, front bottom perspective, top, bottom, left side, right side, rear, and front views, respectively of a first collar 500 in accordance with an embodiment of the present invention. The second collar is section 102 which is incorporated into section 104.

The first collar 500 includes sections 502, 506, and 508. Section 502 may be circular or substantially circular. Section 508 may be a rim which is substantially circular and which is fixed to an end of section 502. Section 506 may be a flat protrusion which is fixed to section 502 and section 508, and which extends out perpendicularly from sections 502 and 508. The first collar 500 includes extensions or protrusions 504*a*, 504*b*, and 504*c*, shown in FIG. 5B, which extend out perpendicularly to the circular shape of section 502. There are gaps 505*a*, 505*b*, and 505*c* between protrusions 504*a* and 504*b*, between 504*b* and 504*c*, and between protrusions 504*c* and 504*a*, respectively. There is an opening or hole 510 through the first collar 500. The first collar 500 may be made of plastic.

Collar 500 is used for the attachment of a $1/300^{th}$ scale metal aircraft model playing piece onto the altitude pole 400.

FIGS. 6A, 6B, 6C, 6D, 6E, 6F, and 6G show front top perspective, left side, right side, top, bottom, rear, and front views, respectively of a pin 600 in accordance with an embodiment of the present invention.

The pin 600 includes sections 602, 604, and 606, as wells as protruding cylinders 608 and 610. The sections 604 and 606 may be triangular. Pin 600 is used to attach a $1/300^{th}$ scale metal diecast aircraft playing piece onto deck 100.

Figure 11A:
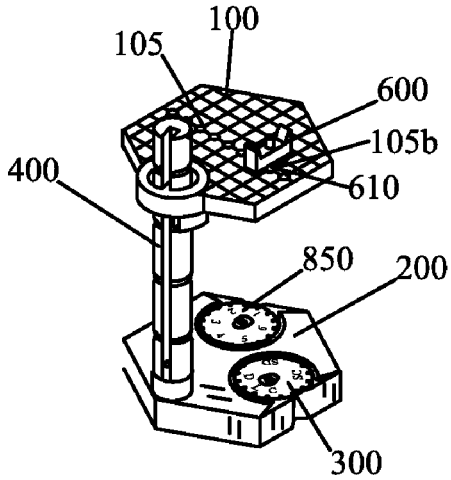
FIG. 11A shows a top perspective view of the altitude pole of FIG. 4A inserted into an opening of the base of FIG. 2A, the deck of FIG. 1A attached to the altitude pole of FIG. 4A, two dials placed on the base of FIG. 2A, and the pin of FIG. 6A inserted into the deck of FIG. 1A.
Figure 11B:
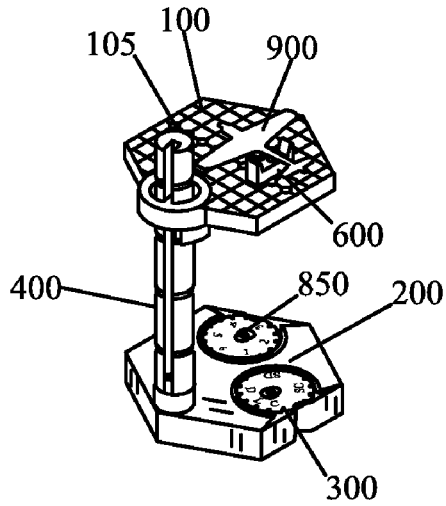
FIG. 11B shows a top perspective view of the altitude pole of FIG. 4A inserted into an opening of the base of FIG. 2A, the deck of FIG. 1A attached to the altitude pole of FIG. 4A, two dials placed on the base of FIG. 2A, the pin of FIG. 6A inserted into the deck of FIG. 1A, and the model airplane of FIG. 9A placed on the pin of FIG. 6A as well as the deck of FIG. 1A.
Figure 11C:
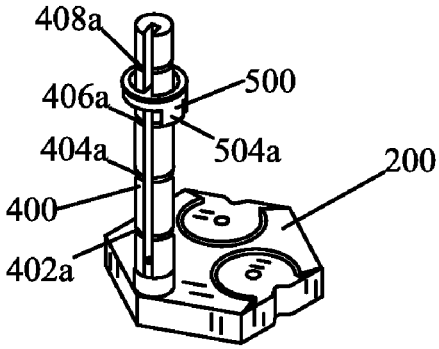
FIG. 11C shows a top perspective view of the altitude pole of FIG. 4A inserted into an opening of the base of FIG. 2A, and the collar of FIG. 5A attached to the altitude pole of FIG. 4A.
Figure 11D:
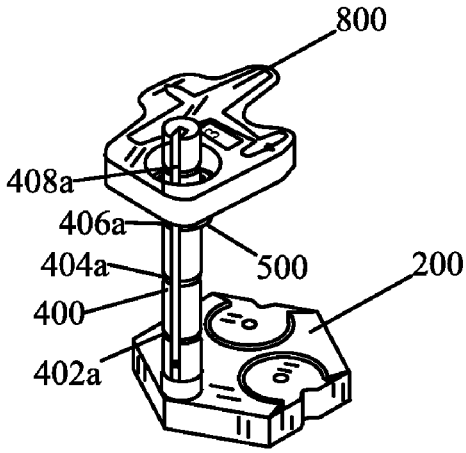
FIG. 11D shows a top perspective view of the altitude pole of FIG. 4A inserted into an opening of the base of FIG. 2A, the collar of FIG. 5A attached to the altitude pole of FIG. 4A, and the cutout of FIG. 8A placed on the collar of FIG. 5A.

A game piece 800 is shown in FIG. 11D which is attached to the vertical pole 400 via the first collar 500, is a cardboard cutout overhead view picture of one of a variety of aircraft that is used in the game. This die cut printed cardboard or game piece 800 is the 2D (two dimensional) representation of the desired aircraft that is held to altitude by collar 500 Should the player be able to afford diecast metal replicas of the period wartime aircraft a deck, such as deck 100 can be employed. The pin, such as pin 600, is employed to reposition on the deck 100, to accommodate balancing of the diecast metal aircrafts female pin hole which the player drills underneath a $1/300^{th}$ scale diecast metal aircraft model playing piece shown in FIG. 11B.

Once the player decides which representation of aircraft he has, he then has the capability of raising and lowering the collar, such as 500, or the deck 100, on the pole 400, to denote four flight altitude bands during the course of a game. Dials, such as dial 300 and pole 400 come affixed to base 200 and collars such as 500, or deck 100 are then applied by a player during the course of the game or historical "Dog Fight".

FIG. 7 shows a game board 700 in accordance with another embodiment of the present invention. The game board 700 includes a plurality of hexagon or hexagonal spaces 702 including hexagon or hexagonal space 702*a*. Each of the hexagon spaces 702 may be about the same as or slightly larger than the hexagon shape of the deck 100 and base 200. The deck 100 or the base 200 can be placed on one of the hexagon spaces 702, such as hexagon space 702*a*. The game board 700 may be made of cardboard, and the hexagonal spaces 702 may be a printed pattern on the game board 700.

Figure 8A:
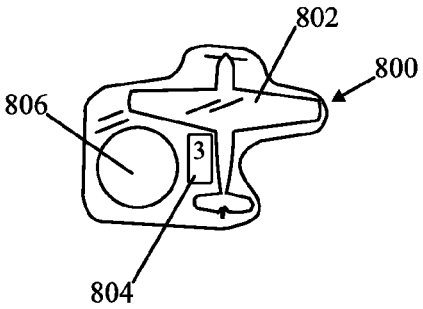
FIG. 8A shows a top view of cutout which shows an image of an airplane on it.

FIG. 8A shows a top view of cutout 800 which shows an image 802 of an airplane on it. The cutout or game piece 800 also has an alpha numerical identifier, in this case "3", which stands for that particular cardboard game piece's position in its formation as discussed in detail in a rules book. The cutout 800 has an opening 806 into which the pole 400 can be inserted to attach or place the cutout 800 on the apparatus shown in FIG. 11D.

Figure 8B:
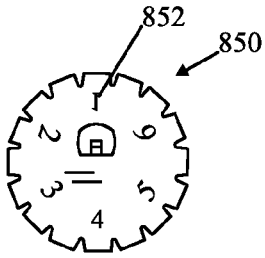
FIG. 8B shows a top view of another dial.

FIG. 8B shows a top view of a dial 850 which may be identical to the dial 300 shown in FIGS. 3A-3H, with the exception that the dial 850 has alphanumeric designations 852, which in this example are "1", "2", "3", "4", "5", and "6" which are used for designation of altitude levels within an altitude band as determined by which slot (402*a*, 404*a*, 406*a* and 408*a*) the collar 500 or deck 100 is affixed to. These differ from the alphanumeric designations shown in FIGS. 3A-3H.

Figure 2A:
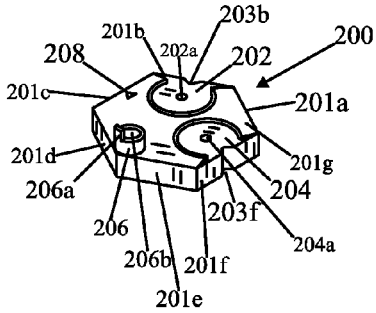
FIG. 2A shows a top perspective view of a base in accordance with an embodiment of the present invention.
Figure 2B:
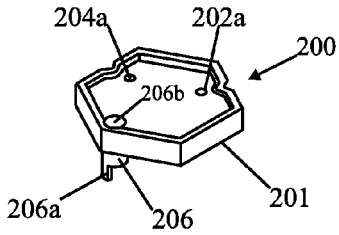
FIG. 2B shows a bottom perspective view of the base of FIG. 2A.
Figure 2C:
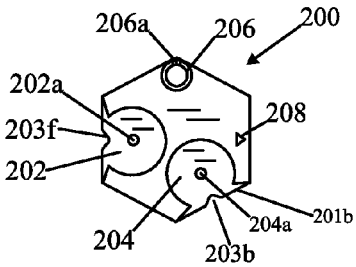
FIG. 2C shows a top view of the base of FIG. 2A.
Figure 2D:
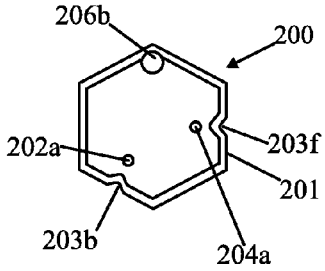
FIG. 2D shows a bottom view of the base of FIG. 2A.
Figure 2E:
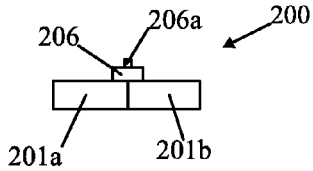
FIG. 2E shows a front view of the base of FIG. 2A.
Figure 2F:
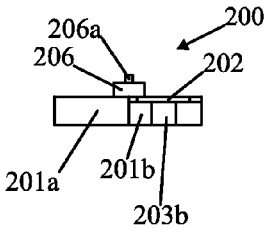
FIG. 2F shows a back view of the base of FIG. 2A.
Figure 2G:
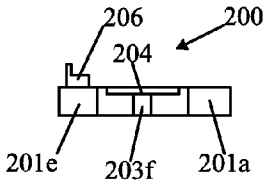
FIG. 2G shows a right side view of the base of FIG. 2A.
Figure 2H:
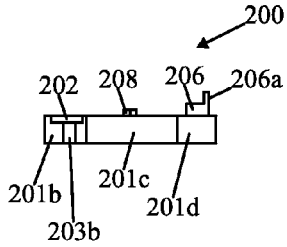
FIG. 2H shows a left side view of the base of FIG. 2A.
Figure 3A:
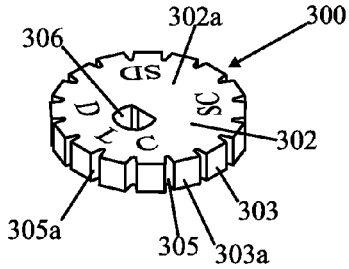
FIG. 3A shows a top perspective view of a first dial or dial A in accordance with an embodiment of the present invention.
Figure 3B:
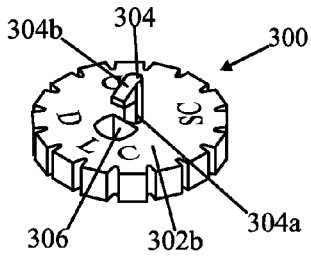
FIG. 3B shows a bottom perspective view of the first dial of FIG. 3A.
Figure 3C:
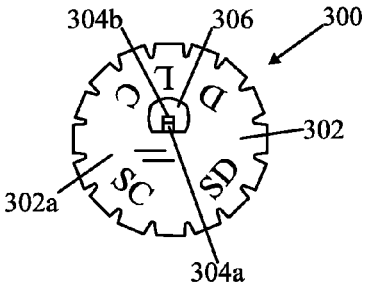
FIG. 3C shows a top view of the first dial of FIG. 3A.
Figure 3D:
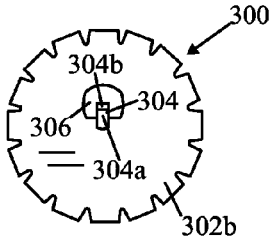
FIG. 3D shows a bottom view of the first dial of FIG. 3A.
Figure 3E:
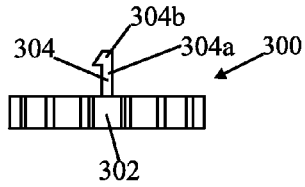
FIG. 3E shows a right side view of the first dial of FIG. 3A.
Figure 3F:
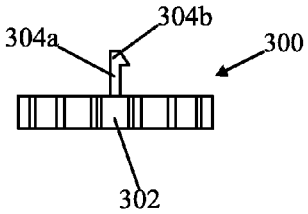
FIG. 3F shows a left side view of the first dial of FIG. 3A.
Figure 3G:
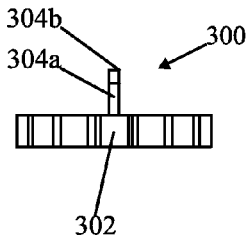
FIG. 3G shows a front view of the deck of FIG. 3A.
Figure 3H:
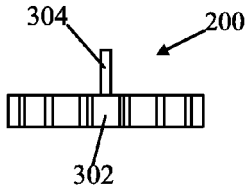
FIG. 3H shows a rear view of the deck of FIG. 3A.
Figure 8C:
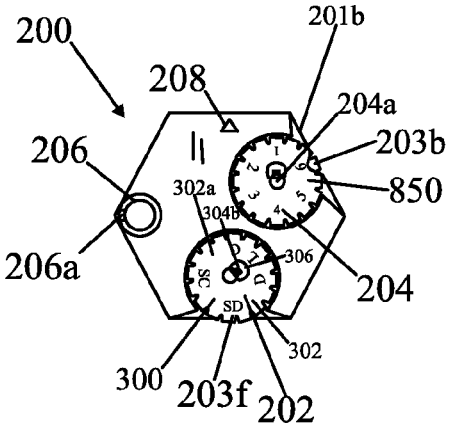
FIG. 8C shows a top view of two dials placed on the base of FIG. 2A.

FIG. 8C shows a top view of dials 300 and 850 placed on the base 200 of FIG. 2A. Dials 300 and 850 and recesses 202 and 204 of the base 200 are configured so that either of dials 300 and 850 fit snugly into either of indentations 202 and 204, and dials 300 and 850 can be spun after being placed in either of indentations 202 and 204 to designate an altitude level via dial 850 and sagittal aircraft position via dial 300.

Figure 8D:
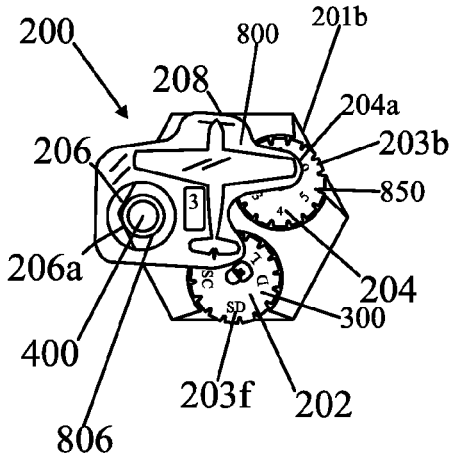
FIG. 8D shows a top view of the cutout of FIG. 8A and the two dials placed on the base of FIG. 2A.

FIG. 8D shows a top view of the cutout 800 of FIG. 8A and the two dials 300 and 850 placed on the base 200 of FIG. 2A. The pole 400 has been inserted through the opening 806 of cutout 800.

Figure 9A:
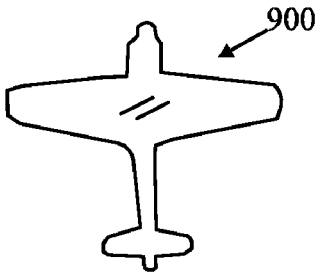
FIG. 9A shows a top view of a model airplane.
Figure 9B:
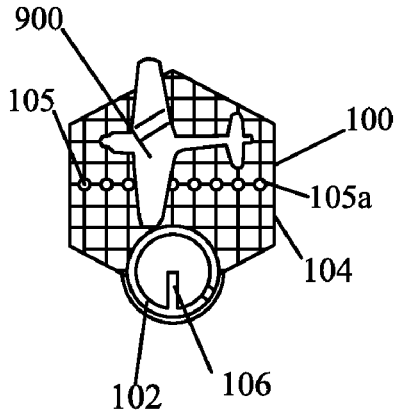
FIG. 9B shows a top view of the model airplane of FIG. 9A on the deck of FIG. 1A.

FIG. 9A shows a top view of a model airplane 900. FIG. 9B shows a top view of the model airplane 900 on the deck 100.

Figure 4A:
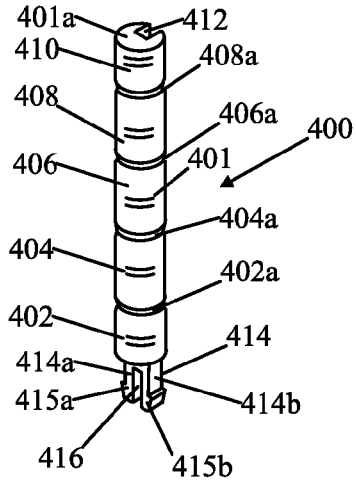
FIG. 4A shows a front top perspective view of an altitude pole in accordance with an embodiment of the present invention.
Figure 4B:
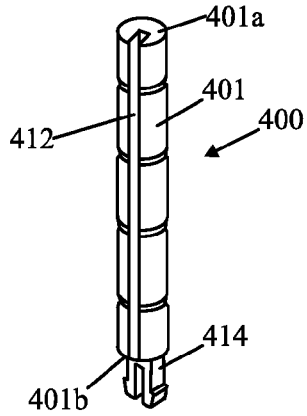
FIG. 4B shows a rear top perspective view of the altitude pole of FIG. 4A.
Figure 4C:
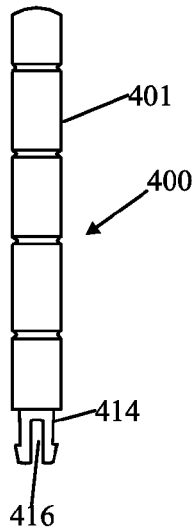
FIG. 4C shows a front view of the altitude pole of FIG. 4A.
Figure 4D:
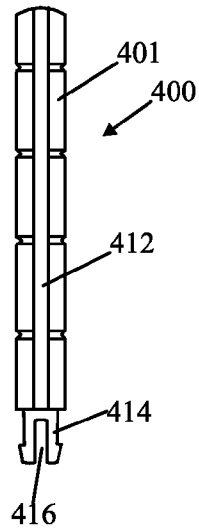
FIG. 4D shows a rear view of the altitude pole of FIG. 4A.
Figure 4E:
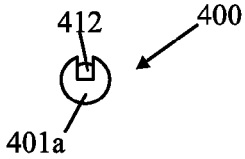
FIG. 4E shows a top view of the altitude pole of FIG. 4A.
Figure 4F:
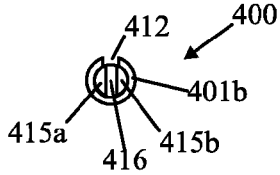
FIG. 4F shows a bottom view of the altitude pole of FIG. 4A.
Figure 5A:
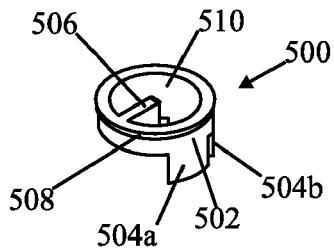
FIG. 5A shows a top perspective view of a first collar A in accordance with an embodiment of the present invention.
Figure 5B:
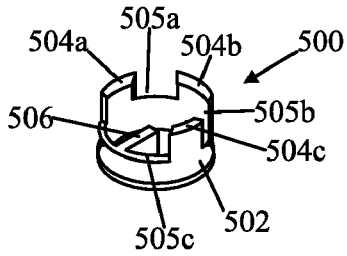
FIG. 5B shows a bottom perspective view of the first collar of FIG. 5A.
Figure 5C:
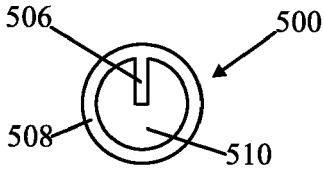
FIG. 5C shows a top view of the first collar of FIG. 5A.
Figure 5D:
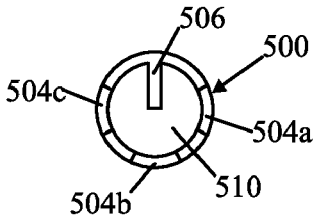
FIG. 5D shows a bottom view of the first collar of FIG. 5A.
Figure 5E:
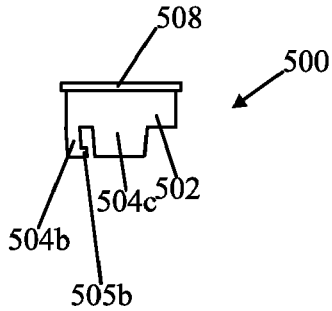
FIG. 5E shows a left side view of the first collar of FIG. 5A.
Figure 5F:
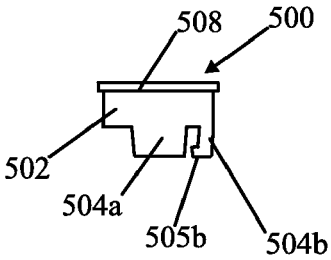
FIG. 5F shows a right side view of the first collar of FIG. 5A.
Figure 5G:
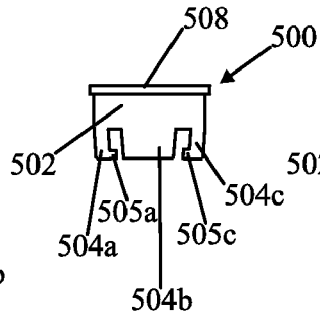
FIG. 5G shows a front view of the first collar of FIG. 5A.
Figure 5H:
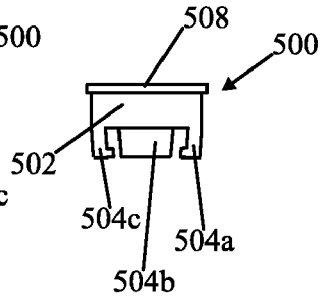
FIG. 5H shows a back view of the first collar of FIG. 5A.
Figure 10A:
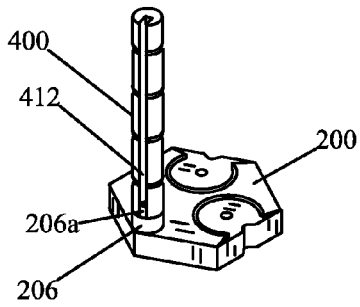
FIG. 10A shows a top perspective view of the altitude pole of FIG. 4A inserted into an opening of the base of FIG. 2A.

FIG. 10A shows a top perspective view of the altitude pole 400 of FIG. 4A inserted into the opening or bore 206*b* of the base 200 of FIG. 2A. In the FIG. 10A configuration, the extensions 414*a*-*b* and the protrusions 415*a*-*b*, shown in FIG. 4A, but not shown in FIG. 10A, have been inserted into the bore 206*b* shown in FIG. 2A, but also not shown in FIG. 10A. The protrusions 415*a*-*b* snap the pole 400 in place into the bore 206*b* into the configuration of FIG. 10A. In addition, the tab 206*a* of the base 200 fits into the elongated slot 412 of the pole 400 to align the pole 400 in the correct orientation with respect to the base 200.

Figure 10B:
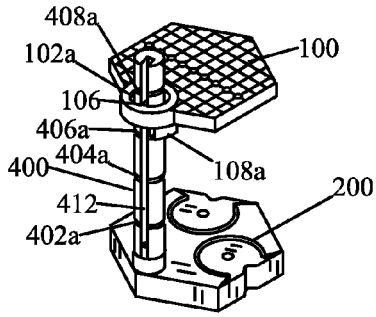
FIG. 10B shows a top perspective view of the altitude pole of FIG. 4A inserted into an opening of the base of FIG. 2A and the deck of FIG. 1A attached to the altitude pole of FIG. 4A.

FIG. 10B shows a top perspective view of the altitude pole 400 of FIG. 4A inserted into the opening or bore 206*b* (shown in FIG. 2A) of the base 200, and the deck 100 attached to the altitude pole 400. In FIG. 10B the altitude pole 400 has been inserted into the opening 102*a* of the deck 100. The flat section 106 slides in the elongated slot 412. The deck 100 is snapped into a position by snapping ridges 109*a*-*c* of protrusions 108*a*-*c*, respectively into one of the slots or indentations 402*a*, 404*a*, 406*a* and 408*a* of the pole 400. In the example of FIG. 10B the ridges 109*a*-*c*, shown in FIG. 1E-1H, but not shown in FIG. 10B, have been snapped into slot or indentation 406*a* of the pole 400, which temporarily fixes the deck 100 at the height shown in FIG. 10B. The protrusions 108*a-c* may be made of plastic and may be flexible so that the deck 100 can be removed from the pole 400 and from the position shown in FIG. 10B.

Figure 1B:
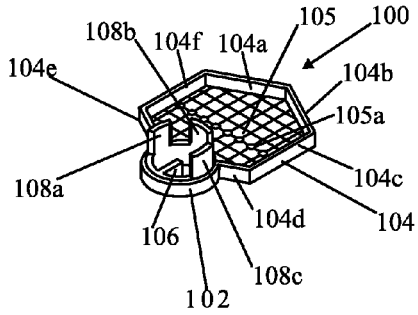
FIG. 1B shows a bottom perspective view of the deck of FIG. 1A.
Figure 1C:
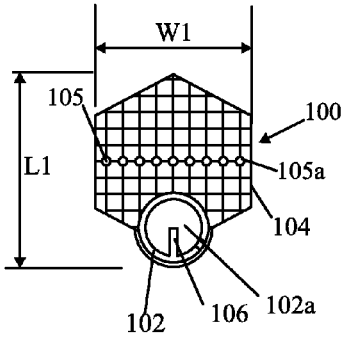
FIG. 1C shows a top view of the deck of FIG. 1A.
Figure 1D:
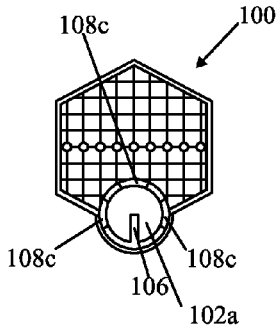
FIG. 1D shows a bottom view of the deck of FIG. 1A.
Figure 1E:
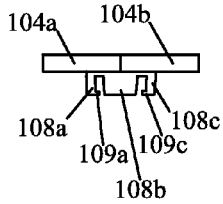
FIG. 1E shows a front view of the deck of FIG. 1A.
Figure 1F:
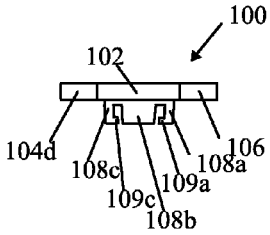
FIG. 1F shows a back view of the deck of FIG. 1A.
Figure 1G:
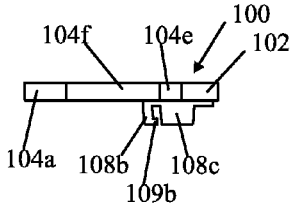
FIG. 1G shows a left side view of the deck of FIG. 1A.
Figure 1H:
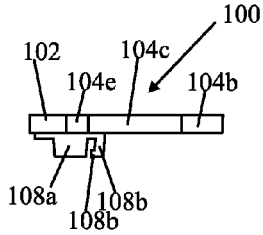
FIG. 1H shows a right side view of the deck of FIG. 1A.
Figure 10C:
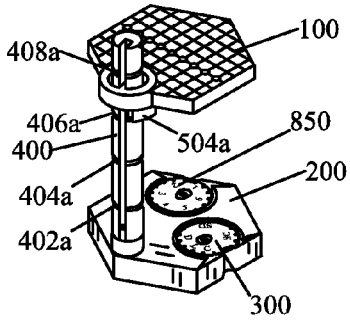
FIG. 10C shows a top perspective view of the altitude pole of FIG. 4A inserted into an opening of the base of FIG. 2A and the deck of FIG. 1A attached to the altitude pole of FIG. 4A, and two dials placed on the base of FIG. 2A.

FIG. 10C shows a top perspective view of the altitude pole 400 of FIG. 4A inserted into the opening 206*b* opening of the base 200 and the deck 100 of FIG. 1A attached to the altitude pole 400 at the position of indentation or slot 406*a* as in FIG. 10B, and two dials 300 and 850 placed on the base 200, such as in indentations 202 and 204 respectively.

Figure 10D:
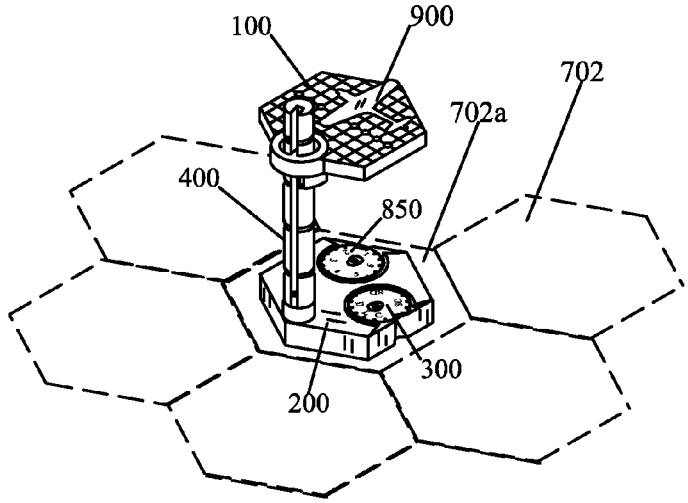
FIG. 10D shows a top perspective view of the altitude pole of FIG. 4A inserted into an opening of the base of FIG. 2A, the deck of FIG. 1A attached to the altitude pole of FIG. 4A, two dials placed on the base of FIG. 2A, the model airplane of FIG. 9A placed on the deck of FIG. 1A, and the base of FIG. 2A placed on a hexagon space of the game board of FIG. 7.

FIG. 10D shows a top perspective view as in FIG. 10C except that the model airplane 900 has been placed on the deck 100 and the entire apparatus has been placed on the hexagonal space 702*a* of the plurality of hexagonal spaces 702 of the board 700 previously shown in FIG. 7. The assembled combination of components 100, 200, 300, 400, 850, and 900 as shown in FIG. 10D may be considered to be a game piece. There may be a plurality of game pieces similar to or identical to that shown in FIG. 10D which may be placed on any of the plurality of hexagonal spaces 702 of the game board 700 of FIG. 7.

Figure 6A:
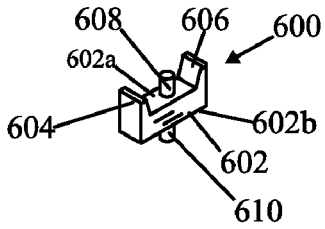
FIG. 6A shows a top perspective view of a pin in accordance with an embodiment of the present invention.
Figure 6B:
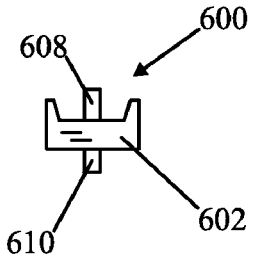
FIG. 6B shows a right side view of the pin of FIG. 6A.
Figure 6C:
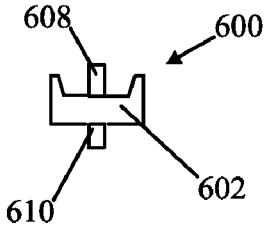
FIG. 6C shows a left side view of the pin of FIG. 6A.
Figure 6D:
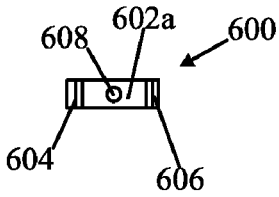
FIG. 6D shows a top view of the pin of FIG. 6A.
Figure 6E:
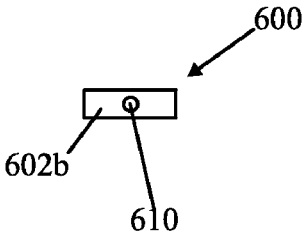
FIG. 6E shows a bottom view of the pin of FIG. 6A.
Figure 6F:
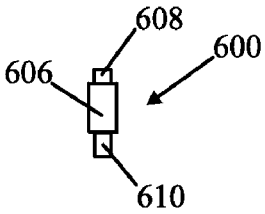
FIG. 6F shows a front view of the pin of FIG. 6A.
Figure 6G:
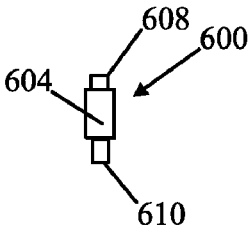
FIG. 6G shows a rear view of the pin of FIG. 6A.

FIG. 11A shows a top perspective view of the altitude pole 400 inserted an snapped into the opening 206*b* of the base 200, the deck 100 of FIG. 1A attached to the altitude pole 400 of FIG. 4A, two dials, 300 and 850, placed on the base 200 of FIG. 2A, and the protruding cylinder 610 the pin 600 of FIG. 6A inserted into a hole 105 of the plurality of holes 105 of the deck 100, thereby attaching the pin 600 to the deck 100.

FIG. 11B shows a top perspective view as in FIG. 11A except that the model airplane 900 has been placed on the deck 100 and has a front portion resting on the pin 600. The model airplane 900 may have an opening, not shown, which may connect to the protruding cylinder 608 shown in FIG. 6A of the pin 600 to connect the airplane 900 to the pin 600.

FIG. 11C shows a top perspective view of the altitude pole 400 of FIG. 4A inserted into the opening 206*b* (shown in FIG. 2A) of the base 200, and the collar 500 attached to the altitude pole 400. The collar 500 may be attached to the pole 400 in a manner similar or identical to the deck 100. The collar 500 includes protrusions 504*a-c* having ridges 505*a-c*, respectively as shown by FIGS. 5E-H. The ridges 505*a-c* snap into one of the indentations 402*a*-408*a* of the pole 400 to temporarily fix the collar 500 at a certain height with respect to the base 200. In the configuration of FIG. 11C, the ridges 505*a-c* (not shown in FIG. 11C, but shown in FIGS. 5E-H) are inserted and snapped into the indentation or slot 406*a* to temporarily fix the collar 500 at the height shown in FIG. 11C.

FIG. 11D shows a top perspective view of the altitude pole 400 inserted into an opening 206*b* (shown in FIG. 2A) of the base 200 of FIG. 2A, the collar 500 (not shown in FIG. 11D, but is underneath the cutout 800) attached to the altitude pole 400, and the cutout 800 placed on the collar 500. The collar 500 supports the cutout 800 at a certain height as shown in FIG. 11D.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus for use in playing a game comprising a deck having a first attachment device and a deck top surface;

a base having a first opening;

an altitude pole having a first end and an opposing second end;

and a first dial;

wherein the altitude pole and the base are configured so that the first end of the altitude pole is adapted to be inserted into the first opening of the base, and the altitude pole is thereby temporarily fixed to the base so that the altitude pole is substantially at a right angle with respect to the base;

wherein the first attachment device of the deck is configured to temporarily fix the deck on the altitude pole between the first end and the second end of the altitude pole, so that the deck top surface is substantially at a right angle with respect to the altitude pole and substantially parallel to the base; and wherein the first dial includes a top surface having a plurality of indications located thereon;

wherein the first dial is attached to the base so that the first dial can rotate with respect to the base and thereby the first dial can be placed in a plurality of orientations with respect to the base ranging from zero to three hundred and sixty degrees;

and wherein the first dial is attached to the base so that all of the plurality of indications located on the top surface of the first dial can be seen regardless of which of the plurality of orientations the first dial is placed in.

2. The apparatus of claim 1 wherein the base includes a first indentation into which the first dial is adapted to fit snugly.

3. The apparatus of claim 1 further comprising a second dial; and wherein the second dial includes a top surface having a plurality of indications located thereon;

wherein the second dial is attached to the base so that the second dial can rotate with respect to the base and thereby the second dial can be placed in a plurality of orientations with respect to the base ranging from zero to three hundred and sixty degrees;

and wherein the second dial is attached to the base so that all of the plurality of indications located on the top surface of the second dial can be seen regardless of which of the plurality of orientations the second dial is placed in.

4. The apparatus of claim 3 and wherein the first dial has a plurality of alphanumeric designations on it; and the second dial has a plurality of alphanumeric designations on it.

5. The apparatus of claim 1 and wherein the first dial has a plurality of alphanumeric designations on it.

6. The apparatus of claim 1 wherein the altitude pole includes means for temporarily fixing the deck at a plurality of different heights with respect to the base.

7. The apparatus of claim 1 further comprising a model airplane which is adapted so that it can sit on the deck, after the deck has been temporarily fixed on the altitude pole;

wherein the model airplane has a top having a top area;

wherein the deck has a top surface on which the model airplane can sit, and wherein the top surface of the deck has an area which is substantially greater than the top area of the model airplane.

8. The apparatus of claim 1 further comprising a cutout having an opening which allows the cutout to be attached to the altitude pole;

and wherein the cutout has an image of an airplane on it.

9. The apparatus of claim 1 wherein the deck has a hexagonal shape;

the base has a hexagonal shape, which is approximately the same size as the hexagonal shape of the deck;

a playing surface comprised of a plurality of hexagonal shaped spaces each of which is approximately the same size or slightly larger than the hexagonal shapes of the base and the deck.

10. The apparatus of claim 1 further comprising a model airplane; and wherein the model airplane and the deck are configured so that the model airplane can be located and connected to the deck at a plurality of different locations on the deck through a corresponding plurality of holes in the deck.

11. An apparatus for use in playing a game comprising a deck having a first attachment device and a deck top surface;

a base having a first opening;

an altitude pole having a first end and an opposing second end;

wherein the altitude pole and the base are configured so that the first end of the altitude pole is adapted to be inserted into the first opening of the base, and the altitude pole is thereby temporarily fixed to the base so that the altitude pole is substantially at a right angle with respect to the base;

wherein the first attachment device of the deck is configured to temporarily fix the deck on the altitude pole between the first end and the second end of the altitude pole, so that the deck top surface is substantially at a right angle with respect to the altitude pole and substantially parallel to the base;

wherein the altitude pole includes means for temporarily fixing the deck at a plurality of different heights with respect to the base;

wherein the means for temporarily fixing the deck at a plurality of different heights with respect to the base includes a plurality of grooves, including a first groove in the altitude pole and a second groove in the altitude pole wherein the first attachment device fits onto the first groove in the altitude pole to fix the deck at a first height with respect to the base, and the first attachment device fits onto the second groove in the altitude pole to fix the deck at a second height with respect to the base.

* * * * *